United States Patent [19]

Paakkinen

[11] Patent Number: 4,539,165

[45] Date of Patent: Sep. 3, 1985

[54] METHOD FOR THE CASTING OF LARGE-SIZE OBJECTS OUT OF A HIGH-VISCOSITY CONCRETE MIX

[75] Inventor: Ilmari Paakkinen, Toijala, Finland

[73] Assignee: Oy Partek AB, Toijala, Finland

[21] Appl. No.: 506,547

[22] PCT Filed: Oct. 21, 1982

[86] PCT No.: PCT/FI82/00045

§ 371 Date: Jun. 10, 1983

§ 102(e) Date: Jun. 10, 1983

[87] PCT Pub. No.: WO83/01594

PCT Pub. Date: May 11, 1983

[30] Foreign Application Priority Data

Nov. 10, 1981 [FI] Finland ..... 813555

[51] Int. Cl.[3] ..... B28B 1/08; B28B 3/00; B30B 9/28

[52] U.S. Cl. ..... 264/23; 264/71; 264/333; 425/409; 425/415; 425/421; 425/432; 425/456

[58] Field of Search ..... 264/23, 69, 71, 72, 264/333; 425/421, 424, 425, 432, 409, 415, 456; 249/172

[56] References Cited

U.S. PATENT DOCUMENTS 3,639,550 2/1972 Darmochwal ..... 425/432

FOREIGN PATENT DOCUMENTS 0959626 3/1957 Fed. Rep. of Germany .
2262846 7/1974 Fed. Rep. of Germany .
1078173 11/1954 France .
936798 11/1975 U.S.S.R. .
0655801 4/1979 U.S.S.R. ..... 264/69

*Primary Examiner*—Donald Czaja
*Assistant Examiner*—Hubert C. Lorin
*Attorney, Agent, or Firm*—Burns, Doane, Swecker & Mathis

[57] ABSTRACT

The invention is concerned with a method and a mould in the casting of large-size concrete objects or corresponding elements for compacting high-viscosity casting mix. Thereat, the mould (3 or 17) comprises a bottom (8 or 24) and side walls (6, 7) as well as, additionally, a deck (9 or 25) for bringing the high-viscosity casting mix present in the mould (3 or 17) mechanically under pressure. According to the invention, repeated parallel dislocations back and forth are produced in the various regional zones of the mechanically pressurized high-viscosity casting mix (1) present in the mould (3 or 17), and in particular in parallel dislocation planes (2) of the casting mix. This is achieved by pivoting two opposite mould (3 or 17) walls (4, 5) or wall portions (20, 21, 22, 23) as synchronized and always in the same direction in relation to each other or in relation to their corresponding portions provided in pairs, which pivoting takes place around shafts (10, 11 or 28, 29) placed at a distance from one another, included in the planes of the said mould walls, and being parallel to each other and to the parallel dislocation planes (2) of the casting mix (1).

3 Claims, 5 Drawing Figures

METHOD FOR THE CASTING OF LARGE-SIZE OBJECTS OUT OF A HIGH-VISCOSITY CONCRETE MIX

The present invention is concerned with a method in the casting of large-size concrete objects or corresponding elements for compacting high-viscosity mix. The invention also comprises a mould for carrying out the method, which mould comprises a bottom and side walls, as well as, moreover, a deck for bringing the high-viscosity casting mix present in the mould mechanically under pressure.

In prior art, it is known to compact the concrete mix by vibration, or to bring the concrete mix in the mould mechanically under pressure by pressing one wall of the mould against the concrete mix. Thereat, in connection with the pressing action, the wall may additionally be varied between various angular positions. In prior art, it is also known to cast hollow slabs out of high-viscosity concrete mix by means of the slide-cast method. In such a case, the cavities of the hollow slab are formed by means of the slide-casting machine so that no thick wall strengths remain in the slab. It is the presence of the cavities that permits the compacting of the high-viscosity concrete mix in the said slide-cast method. On the contrary, in prior art it has not been possible to cast such massive concrete objects or elements whose smallest dimension is also at least tens, possibly even hundreds of millimeters, out of a high-viscosity concrete mix (water/cement ratio about 0.28 to 0.33).

It is an object of the present invention to permit the casting on site of large-size concrete objects or corresponding elements out of a high-viscosity concrete mix, and the method in accordance with the invention is mainly characterized in that repeated parallel dislocations back and forth are produced in the various regional zones of the mechanically pressurized high-viscosity casting mix present in the mould, and in particular in parallel dislocation planes of the casting mix, by pivoting two opposite mould walls or wall portions as synchronized and always in the same direction in relation to each other or in relation to their corresponding portions provided in pairs, which pivoting takes place around shafts placed at a distance from one another, included in the planes of the said mould walls, and being parallel to each other and to the parallel dislocation planes of the casting mix.

The mould in accordance with the invention is mainly characterized in that two opposite walls of the mould, or portions of these walls, have been fitted as synchronously pivotable always in the same direction in relation to one another or to their corresponding portions provided in pairs, around shafts parallel to each other and included in the planes of the said walls.

Figure 1:
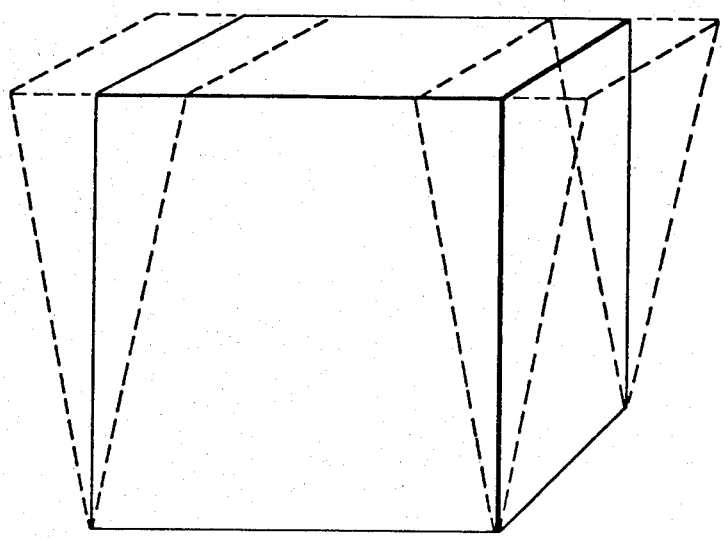
Figure 2:
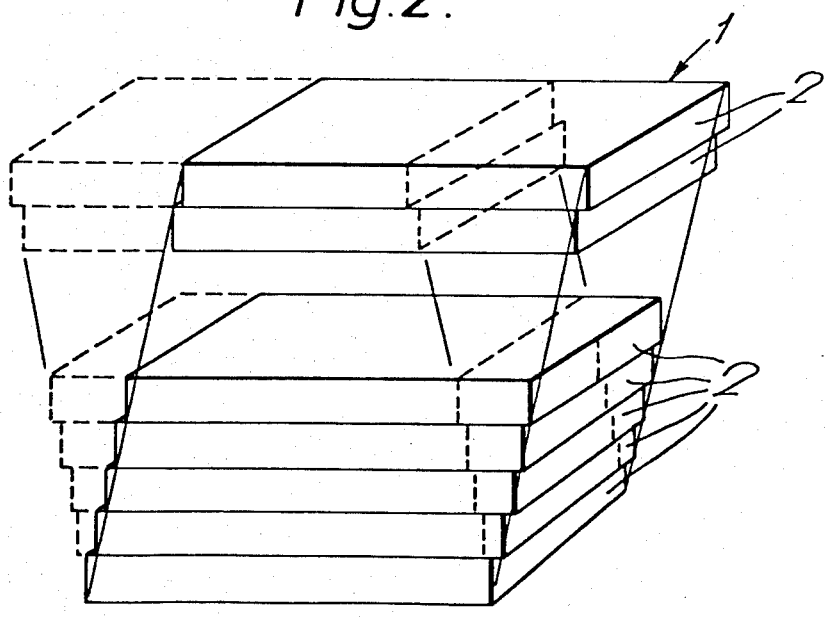
Figure 3:
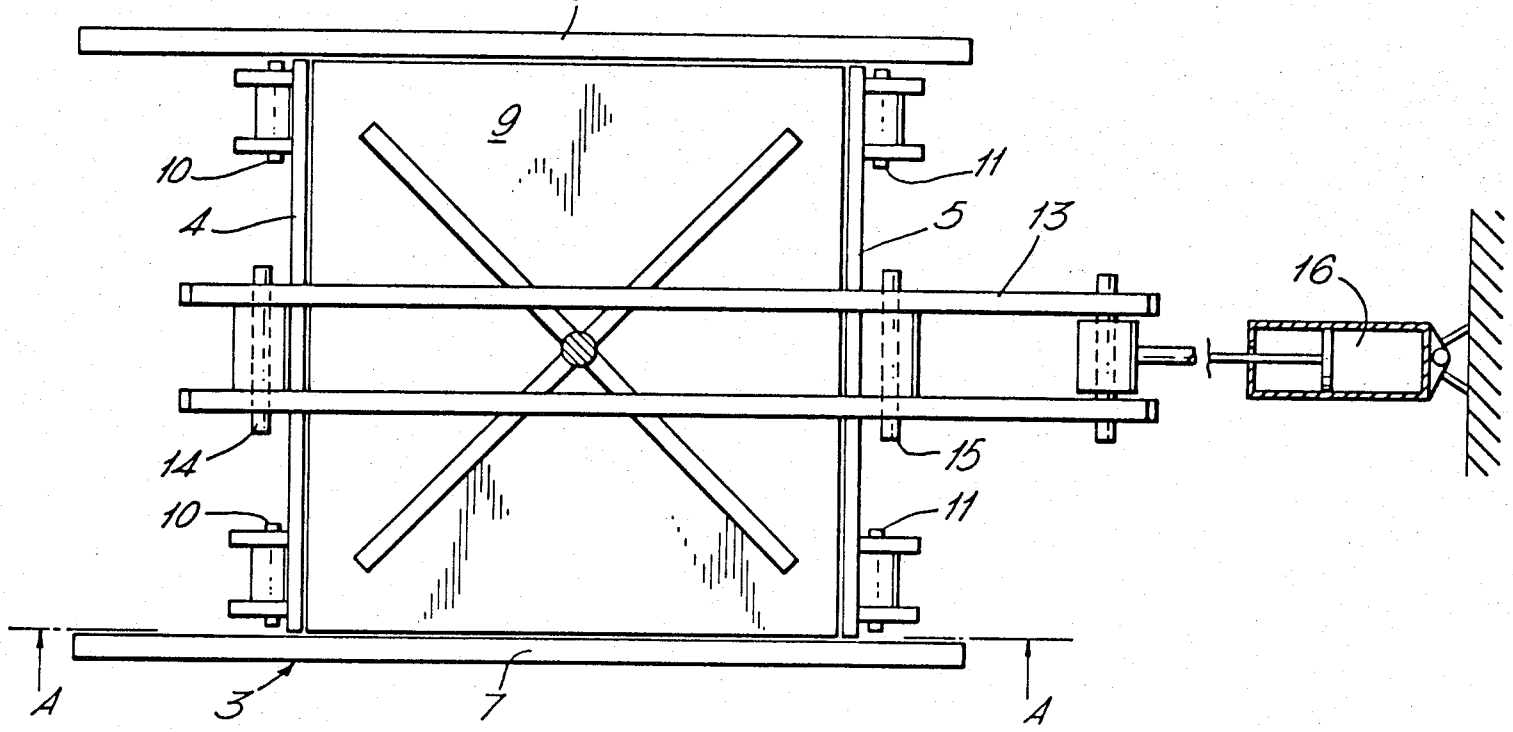
Figure 4:
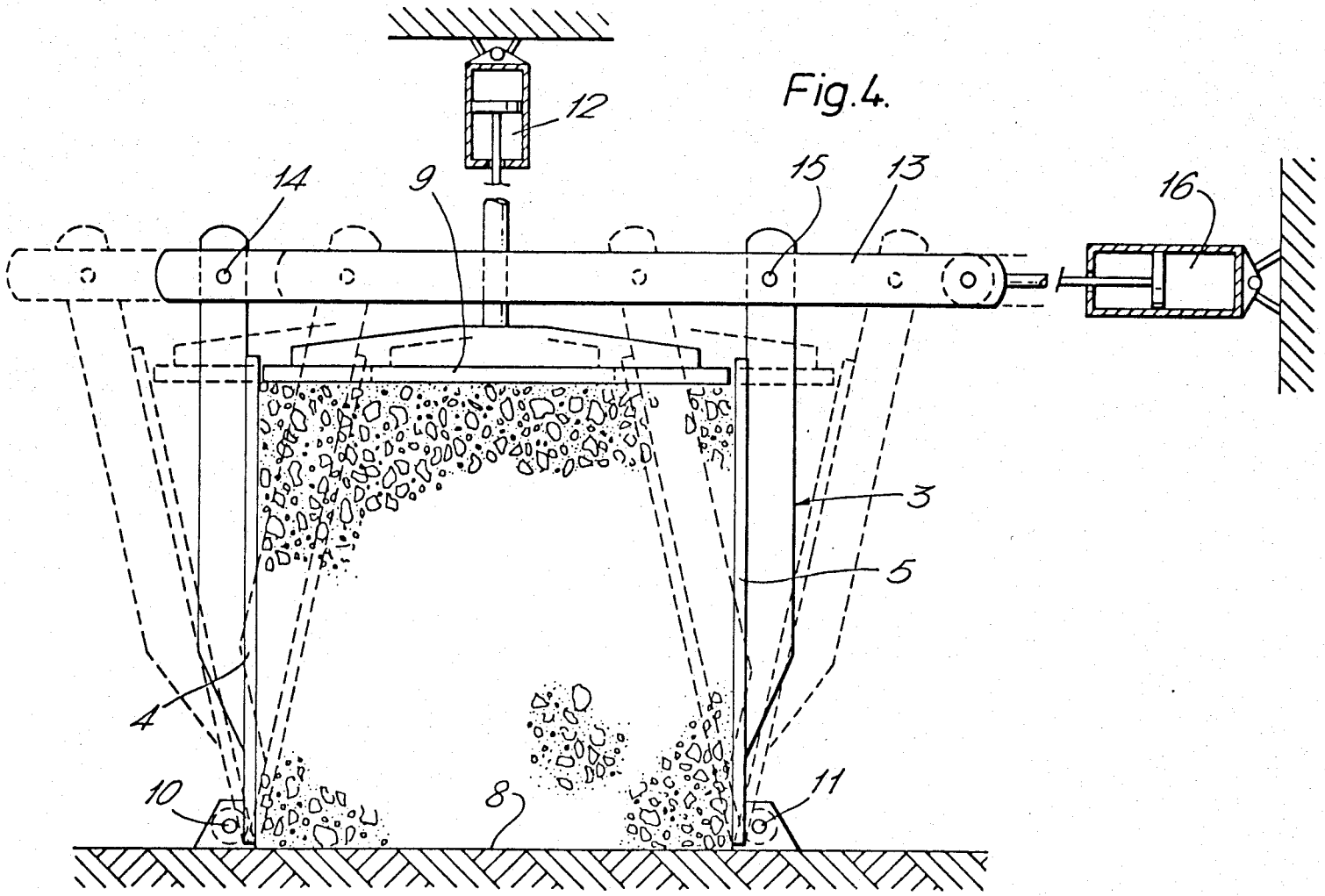
Figure 5:
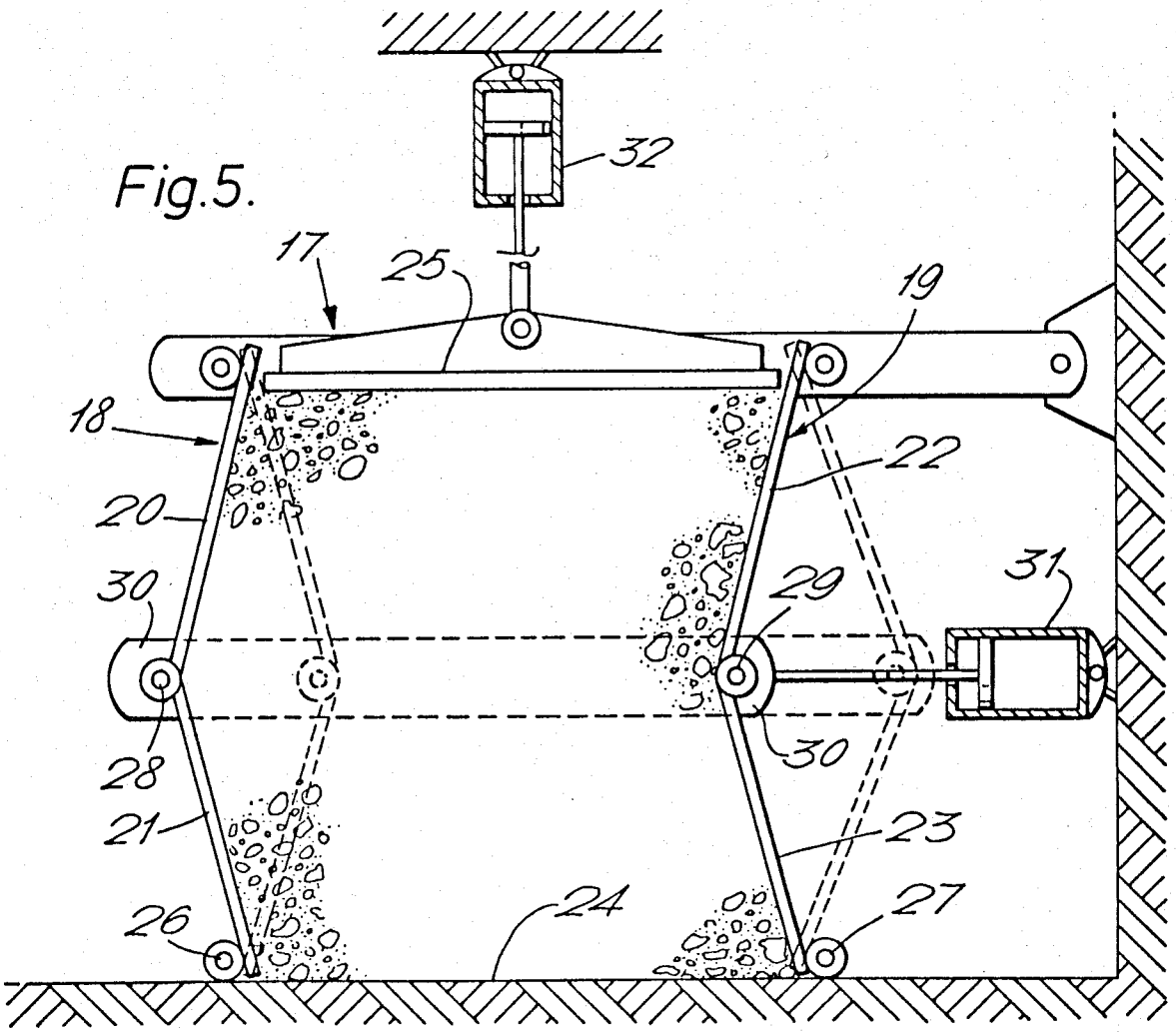

The invention comes out more closely from the following description and from the attached drawing, wherein FIG. 1 is a schematical presentation of the principle of the process of compacting of the concrete mix, FIG. 2 illustrates the gliding of the thin lamellae or dislocation planes of the concrete object to be compacted, in relation to each other in a cubic cast piece, the lamellae being placed one above the other, FIG. 3 is a schematical presentation of a casting mould as viewed from above, FIG. 4 shows a section at A—A in FIG. 3, and FIG. 5 shows a mould construction alternative for the mould shown in FIGS. 3 and 4, as a sectional side view.

In FIG. 1, it is assumed that the object to be compacted out of high-viscosity concrete mix has the shape of a cube, shown in full lines. In order that the high-viscosity concrete mix should be really compacted in all parts of the concrete object, in the concrete mix an efficient dislocation of all of the areas in the mix in relation to each other must be produced throughout the entire object. According to the invention, this is achieved so that the concrete mix is first brought mechanically under pressure and that thereafter, in parallel dislocation planes in the concrete mix, repeated parallel dislocations back and forth are produced by synchronously pivoting two opposite mould walls in relation to each other. In FIG. 1, the paths of movement of the two wall planes concerned are denoted with broken lines.

In order to illustrate the matter, in FIG. 2, the object 1 to be compacted is conceived as consisting of thin lamellae or dislocation planes 2 placed one above the other. When the object 1 is, during compacting, shaped diagonally, the lamellae or dislocation planes 2 glide in relation to each other. In FIG. 2, one extreme position of the working is presented with full lines and the other extreme position with broken lines. In the process of working, the frequency of oscillation may be up to 10 to 20 oscillations back and forth per second, preferably, however, about 1 to 5 oscillations back and forth per second. Therat, during the working, the lamellae or dislocation planes 2 placed one above the other are sort of cut loose from each other as parallel dislocations, and this cutting proceeds through the whole object 1. Repeated shearing together with a pressure pressing the walls of the object 1 produces compacting. In this connection, bringing the high-viscosity concrete mix mechanically under pressure means that a compression is caused in the concrete mix, e.g., by pressing the deck plane of the mould downwards. The presentation in FIG. 2 is, of course, only a presentation illustrating the process of compacting of the high-viscosity concrete mix. Of course, in practical performance, the side walls remain plane, i.e. it is assumed that the thickness of the lamellae is close to zero. Nevertheless, an efficient "shearing" of the concrete mix takes place in the concrete object 1 to be compacted, in the way described above, throughout the entire object.

FIGS. 3 and 4 show a mould for casting on site of large concrete objects or elements and for compacting of high-viscosity concrete mix. The mould 3 comprises a bottom 8, stationary side walls 6 and 7, as well as a horizontal mould deck 9 movable in the vertical direction by means of a cylinder-piston device 12. At the plane of the mould 3 bottom 8, pivotable walls or wall portions 4 and 5 of the mould 3 have been mounted by means of horizontal shafts 10 and 11. The side walls or wall portions 4 and 5 of the mould 3, pivoting at their upper parts, are, by means of articulated joints 14 and 15, connected to a connecting rod 13, and to the other end of the connecting rod a horizontal cylinder-piston device 16 has been connected, by means of which, via the connecting rod 13, synchronized back-and-forth pivoting movement of the pivotable side walls or wall portions 4 and 5 of the mould 3 is produced. Thus, the side walls or wall portions 4 and 5 pivot by means of the cylinder-piston device 16 and of the connecting rod 13 around the shafts 10 and 11 in the way shown by broken lines in FIG. 4.

Thus, when the concrete object is being cast, the mould 3 is filled with the high-viscosity concrete mix and the concrete mix is compressed from above by means of the mould deck 9 by pressing the deck downwards by means of the cylinder-piston device 12. Thereby the high-viscosity concrete mix in the mould 3 is brought mechanically under pressure. Hereupon, repeated parallel dislocations back and forth are produced in the parallel dislocation planes of the high-viscosity concrete mix by pivoting two opposite mould walls or wall portions 4 and 5 by means of a cylinder-piston device 16 and of a connecting rod 13 around the shafts 10 and 11 synchronously always in the same direction in relation to one another. The cylinder-piston device 12 presses the mould 3 deck 9 by a uniform force, whereat a pressure is produced in the concrete to be compacted, e.g. about 0.5 to 1 bar. After sufficient compacting of the concrete object has been achieved, the concrete is so rigid that the cast piece can be removed from the mould 3 immediately after the compacting movement described above has been stopped.

FIG. 5 shows a mould construction alternative to that shown in FIGS. 3 and 4. Therein, like in the embodiment of FIGS. 3 and 4, the mould 17 has a bottom 24, two stationary walls at opposite sides of the mould 17, and the mould 17 deck 25. The mould 17 also has two opposite mobile walls 18 and 19. The mobile walls 18 and 19 are pivotably mounted by means of shafts 26 and 27 to the plane of the bottom 24 of the mould 17, but, additionally, the walls 18 and 19 have been designed as folding at the middle in relation to the articulated shafts 28 and 29. Thus, the side wall 18 consists of two wall portions 20 and 21, which can pivot in relation to each other around the articulated shaft 28. Correspondingly, the side wall 19 consists of wall portions 22 and 23, which can pivot in relation to each other around the articulated shaft 29. The articulated shafts 28 and 29 have been connected to a connecting rod 30, a horizontal cylinder-piston device 31 being connected to the other end of the said rod. In the embodiment shown in FIG. 5, the high-viscosity concrete mix is brought mechanically under pressure by means of the mould 17 deck 25 by pressing the deck 25 downwards by means of the cylinder-piston device 32. The compacting movement in the concrete mix is produced by means of the cylinder-piston device 31 by oscillating the parts 20 and 21 as well as 22 and 23 of the pivotable walls 18 and 19 of the mould 13 between the two extreme positions shown in FIG. 5. In the compacting process, the angle of pivoting of the side walls or of their parts is about 20° to 30°, i.e. the movement of pivoting of a side wall or its parts from the middle position to both sides is about 10° to 15°.

Of course, in the casting method in accordance with the present invention, the shape of the object to be compacted does not have to be that of a cube or a rectangular prism, but many different alternative shapes can be concerned. The faces of the object to be compacted may also be, e.g., curved faces. If the forms of the cast object to be compacted differ from plane faces, then, of course, the circumstance must be taken into account that the forms of the object should not prevent efficient compacting as the side walls of the mould, or their portions, are moved during the compacting action. In stead of concrete mix, the casting mix may also consist of some other high-viscosity mix suitable for the compacting method now concerned.

What is claimed is:

1. A method in the casting of large-size concrete objects or corresponding elements for compacting high-viscosity mix, wherein repeated parallel dislocations back and forth are provided in various regional zones of the mechanically pressurized high-viscosity casting mix present in the mould, and in particular in parallel dislocation planes of the casting mix, by pivoting two opposite mould wall portions in synchronization and always in the same direction in relation to each other, said pivoting provided by a plurality of shafts at a spaced distance from one another, said plurality of shafts positioned in planes defined by said mould walls, and parallel to each other and to the parallel dislocation planes of the casting mix.

2. A method as claimed in claim 1, wherein the wall portions of the mould are oscillated at a frequency which is, at the maximum, 10 to 20 oscillations per second.

3. A method as claimed in claim 1, wherein the pivoting between extreme positions of the pivoting movement of the wall portions of the mould is about an angle of 20° to 30°.

* * * * *